US009861875B2

(12) United States Patent
Cho et al.

(10) Patent No.: US 9,861,875 B2
(45) Date of Patent: Jan. 9, 2018

(54) ACCIDENT PREVENTING SYSTEM FOR SPORTS

(71) Applicant: NATIONAL DISASTER MANAGEMENT RESEARCH INSTITUTE, Ulsan (KR)

(72) Inventors: Simjung Cho, Busan (KR); Dugkeun Park, Ulsan (KR); Hoon Lee, Ulsan (KR); Taewoong Jung, Ulsan (KR); Hyunjung Kim, Ulsan (KR); Minjung Kim, Ulsan (KR)

(73) Assignee: NATIONAL DISASTER MANAGEMENT RESEARCH INSTITUTE (KR)

( * ) Notice: Subject to any disclaimer, the term of this patent is extended or adjusted under 35 U.S.C. 154(b) by 0 days.

(21) Appl. No.: 15/348,976

(22) Filed: Nov. 10, 2016

(65) Prior Publication Data

US 2017/0165554 A1 Jun. 15, 2017

(30) Foreign Application Priority Data

Dec. 11, 2015 (KR) ..... 10-2015-0176592

(51) Int. Cl.

*A63G 31/00* (2006.01)
*A63G 21/22* (2006.01)
*A63B 71/00* (2006.01)

(52) U.S. Cl.

CPC ..... *A63B 71/0054* (2013.01); *A63G 21/22* (2013.01); *A63G 31/00* (2013.01); *A63B 2071/0081* (2013.01); *A63B 2230/015* (2013.01); *A63G 2031/002* (2013.01)

(58) Field of Classification Search

CPC ... A63J 11/00; A63G 3/00; A63G 3/02; A63G 21/00; A63G 21/18; A63G 31/00; A63G 31/16; G08B 25/00; G08B 25/08; G08B 25/10; G08B 21/02; G06K 17/00

USPC ..... 472/59, 62, 136

See application file for complete search history.

(56) References Cited

U.S. PATENT DOCUMENTS 6,095,927 A * 8/2000 Malone ..... A63J 11/00 472/128
8,574,085 B1 * 11/2013 Jackson ..... A63J 11/00 472/136
9,399,178 B1 * 7/2016 Jackson ..... A63J 11/00

FOREIGN PATENT DOCUMENTS

KR 20060101405 A 9/2006
KR 101212657 B1 1/2013

* cited by examiner

*Primary Examiner* — Kien Nguyen
(74) *Attorney, Agent, or Firm* — Renaissance IP Law Group LLP

(57) ABSTRACT

An accident preventing system for sports, for preventing an accident to a user who uses a sport facility involving movement from a first zone including a starting spot to a second zone including an arrival spot, includes a safety equipment that a user wears to use the sport facility, an entry sensing unit installed in the first zone and determining that the user enters the starting spot, a binding sensing unit installed in the first zone and determining whether the safety equipment is bound, and a controller determining whether to operate the sport facility upon receiving signals checked by the entry sensing unit and the binding sensing unit.

7 Claims, 11 Drawing Sheets

ACCIDENT PREVENTING SYSTEM FOR SPORTS

BACKGROUND OF THE INVENTION

1. Field of the Invention

The present disclosure relates to an accident preventing system for sports.

2. Description of Related Art

Sports refers to activity aiming to promote health or foster a sound mind through physical activity. Sports positively affects users physically or mentally. Flexibility and balance of human bodies may be enhanced through activity of joints and muscles. Also, sports resolves tension and allows a person to have confidence by overcoming his or her limitation.

Leisure sports, a type of sports involving movement from a first zone to a second zone, includes bungee jumping, euro jump, and zipline, and the like. Leisure sports is sports allowing users to traverse or fly over mountain, lake, river, sea, and the like. Leisure sports generally relies on a safety equipment worn on users but is highly risky, so users should be careful of an accident.

Recently, when leisure sports is used, a safety equipment that a user wears may not be properly bound to the user's body or the safety equipment worn on the user may not be properly bound to a facility member to cause an accident.

SUMMARY OF THE INVENTION

Therefore, an aspect of the detailed description is to provide an accident preventing system for sports, capable of preventing an accident to a user who uses sport facilities.

Advantages and features of the present disclosure and implementation methods thereof will be clarified through following exemplary embodiments described with reference to the accompanying drawings.

To achieve these and other advantages and in accordance with the purpose of this specification, as embodied and broadly described herein, an accident preventing system for sports, for preventing an accident to a user who uses a sport facility involving movement from a first zone including a starting spot to a second zone including an arrival spot, includes: a safety equipment that a user wears to use the sport facility; an entry sensing unit installed in the first zone and determining that the user enters the starting spot; a binding sensing unit installed in the first zone and determining whether the safety equipment is bound; and a controller determining whether to operate the sport facility upon receiving signals checked by the entry sensing unit and the binding sensing unit.

The safety equipment may include: a safety equipment coupling part binding the safety equipment worn on the user; and a safety equipment coupling sensor determining whether the safety equipment coupling part is bound.

The safety equipment may include: a safety equipment upper part covering the user's upper body; and a safety equipment lower part covering the user's thighs, wherein the safety equipment coupling part includes a safety equipment first coupling part binding the safety equipment upper part not to be slipped and a safety equipment second coupling part binding the safety equipment lower part not to be slipped.

The accident preventing system may further include: a starting spot gate installed in the starting spot and preventing entry of another user when the user's entry is checked.

The accident preventing system may further include: at least one facility member installed in the first zone and the second zone to allow the user to move from the first zone to the second zone; a facility member coupling part positioned at an end of the facility member and coupled to the safety equipment; and a coupling sensing unit installed in the first zone and checking coupling between the facility member coupling part and the safety equipment.

The accident preventing system may further include: a signal transmitting unit transmitting signals sensed by the entry sensing unit, the binding sensing unit, and the coupling sensing unit; a signal receiving unit receiving a signal transmitted from the signal transmitting unit and transferring the received signal to the controller; and a warning unit determining whether the user is allowed to use the sport facility through a signal transferred from the controller, and give a warning.

The entry sensing unit may include a weight sensor measuring a weight of the user and checking the user's entry, and the controller may include a tension calculation unit calculating tension acting on the facility member due to the weight of the user measured through the weight sensor.

The controller may include: a checking unit determining whether the entry sensing unit, the binding sensing unit, and the coupling sensing unit sense a signal, and a notification unit notifying about occurrence of an error when it is determined through the checking unit that the entry sensing unit, the binding sensing unit, and the coupling sensing unit do not operate.

The accident preventing system may further include: an emergency sensing unit installed in the first zone and replacing a signal sensing function when it is determined through the checking unit that the entry sensing unit, the binding sensing unit, and the coupling sensing unit do not operate.

According to the embodiments of the present disclosure, whether the safety equipment that a user wears is bound to the user may be determined. When the safety equipment is not bound to the human body, a warning may be provided through the warning unit. When one user enters the starting spot, the starting spot gate may be closed. An operation of the sport facility may be stopped through the controller. Whether the safety equipment worn on the user and the facility member are bound may be determined. An accident in sports may be effectively prevented.

BRIEF DESCRIPTION OF DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION

Figure 1:
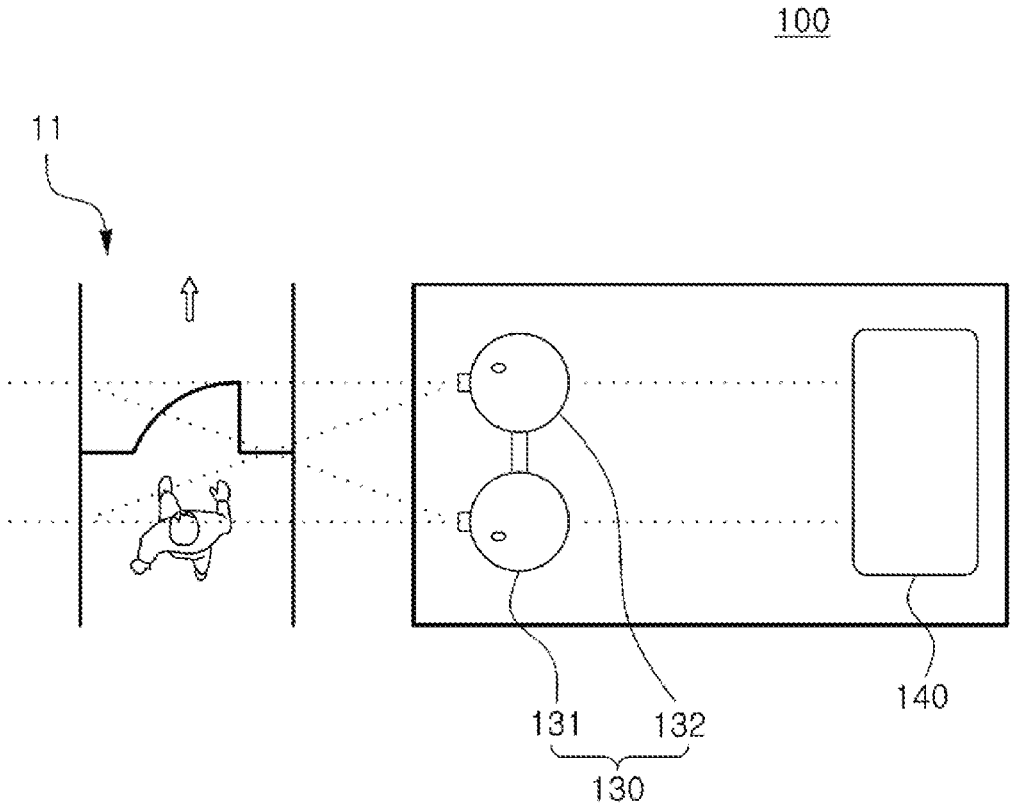
FIG. 1 is a view schematically illustrating an accident preventing system for sports according to an embodiment of the present disclosure.

Hereinafter, the present disclosure will be described in detail by using embodiments. Objects, features and advantages of the present disclosure will be readily understood through the following examples. The present disclosure is not limited to the embodiments described herein, and may be embodied in other forms. The exemplary embodiments introduced herein are provided to make disclosed contents thorough and complete and to sufficiently transfer the spirit of the present disclosure to those skilled in the art of the present disclosure. Accordingly, the present disclosure is not to be limited by the following embodiments Terms such as first, second, and the like, are used to describe various elements, but those elements should not be limited by these terms. Such terms are used for merely discriminating the corresponding elements from other elements. When a certain element is mentioned to be on top of another element, it should be understood that the certain element may be directly formed on the other element or a third element may be interposed therebetween.

The size of the element or the relative sizes between elements in the drawings may be shown to be exaggerated for more clear understanding of the present disclosure. In addition, the shape of the elements shown in the drawings may be somewhat changed by variation of the manufacturing process or the like. Accordingly, the embodiments disclosed herein are not to be limited to the shapes shown in the drawings unless otherwise stated, and it is to be understood to include a certain amount of variation.

FIG. 1 is a view schematically illustrating an accident preventing system for sports according to an embodiment of the present disclosure.

Referring to FIG. 1, an accident preventing system 100 for sports may include a sensing unit 130 and a controller 140. The accident preventing system 100 for sports may prevent an accident to a user who uses a sport facility 1 in which the user moves from a first zone 10 including a starting spot 11 to a second zone 30 including an arrival point.

The sensing unit 130 may include an entry sensing unit 131 and a binding sensing unit 132.

The entry sensing unit 131 may be installed in the first zone 10. The entry sensing unit 131 may be installed in the starting spot 11 or may be positioned in the vicinity of the starting spot 11, and may identify a user who enters the starting spot 11. The entry sensing unit 131 may sense entry of a user in a region available to be sensed. A sensor used in the entry sensing unit 131 may include a motion sensor, an infrared sensor, a radio frequency (RF) sensor, an optical sensor, and the like.

The binding sensing unit 132 may determine whether a safety equipment 110 worn on the user has been bound. The binding sensing unit 132 may sense whether the safety equipment 100 within a sensing-available region has been bound. The binding sensing unit 132 may sense a safety equipment coupling part sensor 120*a* coupled to the safety equipment 110. The binding sensing unit 132 may be installed in the first zone 10. The binding sensing unit 132 may be installed in the starting spot 11 or may be positioned in the vicinity of the starting spot 11 and may be sensed after the entry sensing unit 131 identifies the user. When a user has passed through the entry sensing unit 131, whether the safety equipment 110 of the user is bound may be determined through the binding sensing unit 132.

Although not shown, sensors used in the entry sensing unit 131 and the binding sensing unit 132 may be integrated to be implemented as a single module.

The controller 140 may check signals sensed by the entry sensing unit 131 and the binding sensing unit 132. Upon receiving the sensed signals, the controller 140 may determine whether the sport facility 1 has an error and determine whether to operate the sport facility 1. When the sport facility 1 has a problem, the controller 140 may stop operation of the sport facility 1. Also, when an operation of the sport facility 1 has a problem, the controller 140 may interrupt entry of a user. Although not shown, when power is interrupted, the controller 140 may operate the sport facility 1 through an emergency generator.

Figure 2:
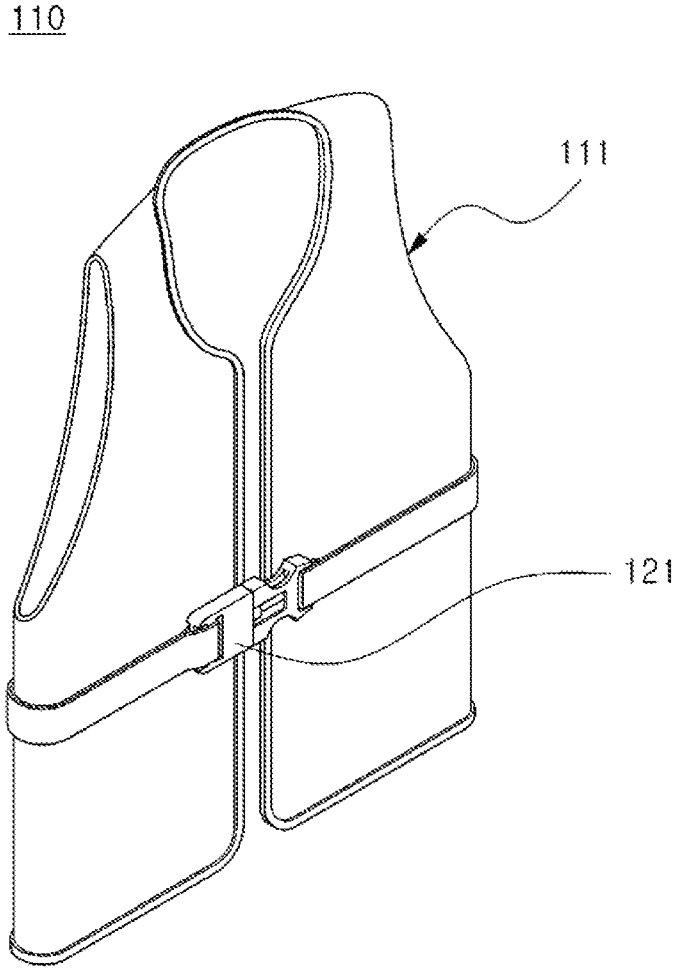
FIG. 2 is a view schematically illustrating a safety equipment according to an embodiment of the present disclosure.
Figure 3:
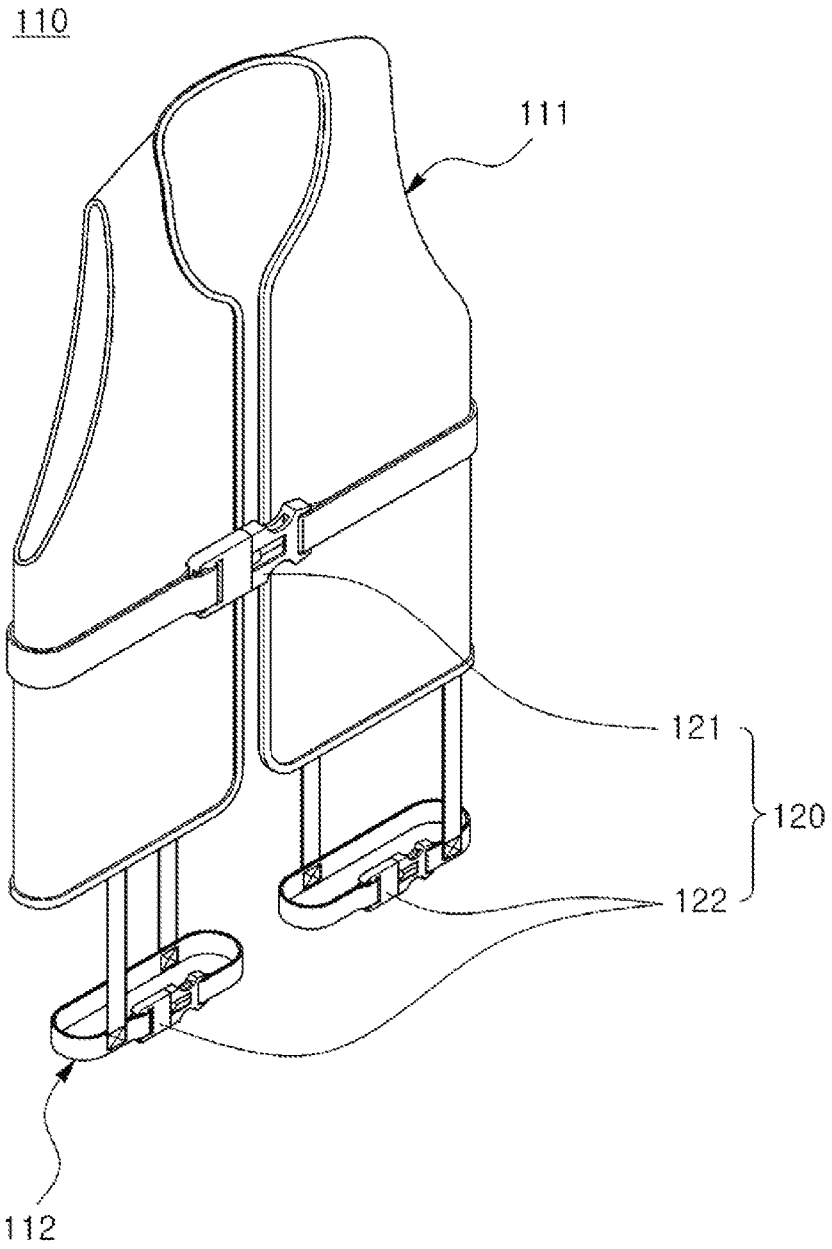
FIG. 3 is a view schematically illustrating a safety equipment according to another embodiment of the present disclosure.

FIG. 2 is a view schematically illustrating a safety equipment according to an embodiment of the present disclosure, and FIG. 3 is a view schematically illustrating a safety equipment according to another embodiment of the present disclosure.

Referring to FIGS. 2 and 3, the user may wear the safety equipment 110 in preparation for an accident that may occur in using the sport facility 1. The safety equipment 110 may include a safety jacket, a life jacket, a safety belt, a harness, and the like.

The safety equipment 110 may include a safety equipment upper part 111 and a safety equipment lower part 112. In order to prevent slip of the safety equipment 110, the user may wear the safety equipment 110 including the safety equipment upper part 111 and the safety equipment lower part 112. The safety equipment upper part 111 may be worn on the user's upper body for the purpose of safety of the user. The safety equipment lower part 112 may be worn on the user's thighs.

A safety equipment coupling part 120 may include a safety equipment first coupling part 121 and a safety equipment second coupling part 122. The safety equipment first coupling part 121 may bind the safety equipment upper part 111 not to be slipped. The safety equipment second coupling part 122 may bind the safety equipment lower part 112 not to be slipped.

Figure 4:
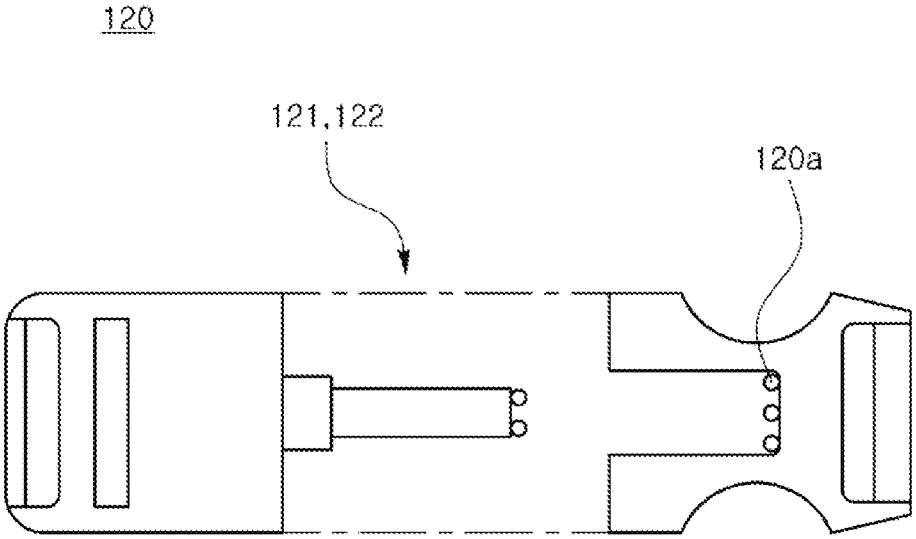
FIG. 4 is a view schematically illustrating a coupling part of a safety equipment according to an embodiment of the present disclosure.

FIG. 4 is a view schematically illustrating a coupling part of a safety equipment according to an embodiment of the present disclosure.

Referring to FIG. 4, the safety equipment coupling part 120 may include a safety equipment coupling part sensor 120*a*. The binding sensing unit 132 may sense the safety equipment coupling part sensor 120*a*. When the safety equipment coupling part 120 is coupled, the safety equipment coupling part sensor 120*a* is sensed and it may be recognized that the safety equipment is bound to the human body. The safety equipment coupling part 120 may include a buckle type, a "a"-shaped ring type, a Velcro type, uneven joint, and the like.

Figure 5:
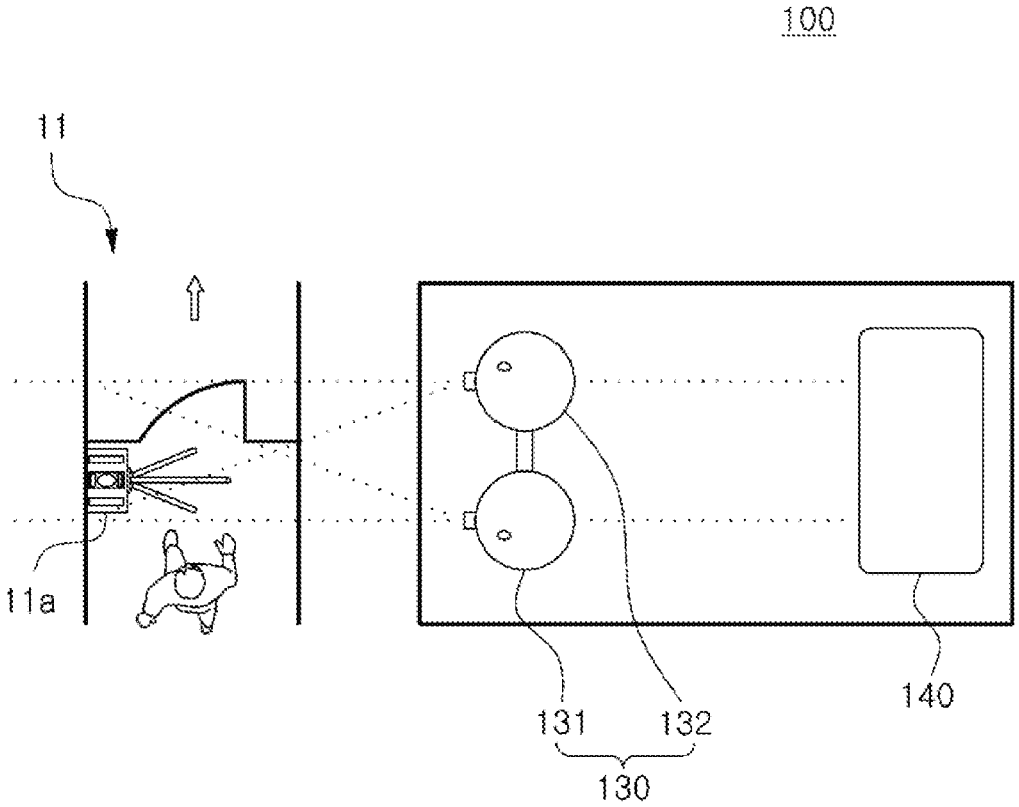
FIG. 5 is a view schematically illustrating an accident preventing system for sports according to another embodiment of the present disclosure.

FIG. 5 is a view schematically illustrating an accident preventing system for sports according to another embodiment of the present disclosure.

Referring to FIG. 5, the accident preventing system 100 for sports may include a starting spot gate 11*a*.

The starting spot 11 may be positioned in the first zone. The starting spot 11 may be implemented such that the user may enter it. When the user passes through the starting spot 11, user's entry may be confirmed by the entry sensing unit 131. When the user passes through the starting spot 11, whether the safety equipment 110 is bound to the user may be determined by the binding sensing unit 132. In FIG. 5, the starting spot 11 is partitioned by a wall, but a configuration without the wall may not be excluded.

When the starting spot gate 11*a* checks entry of one user through the entry sensing unit 131, the starting spot gate 11*a* may prevent entry of another user. That is, when one user passes through the starting spot gate 11*a*, the starting spot gate 11*a* may close an entrance such that two or more users may not simultaneously pass through the starting spot 11. The starting spot gate 11*a* may be installed within a sensing area of the entry sensing unit 131, or may be installed outside the sensing region of the entry sensing unit 131. The starting spot gate 11*a* may be installed outside the sensing region of the entry sensing unit 131 to check a ticket purchased by a user of the sport facility 1. Also, the starting spot gate 11*a* may be installed outside the sensing area of the entry sensing unit 131 to replace the entry sensing unit 131 to check entry of a user.

Figure 6:
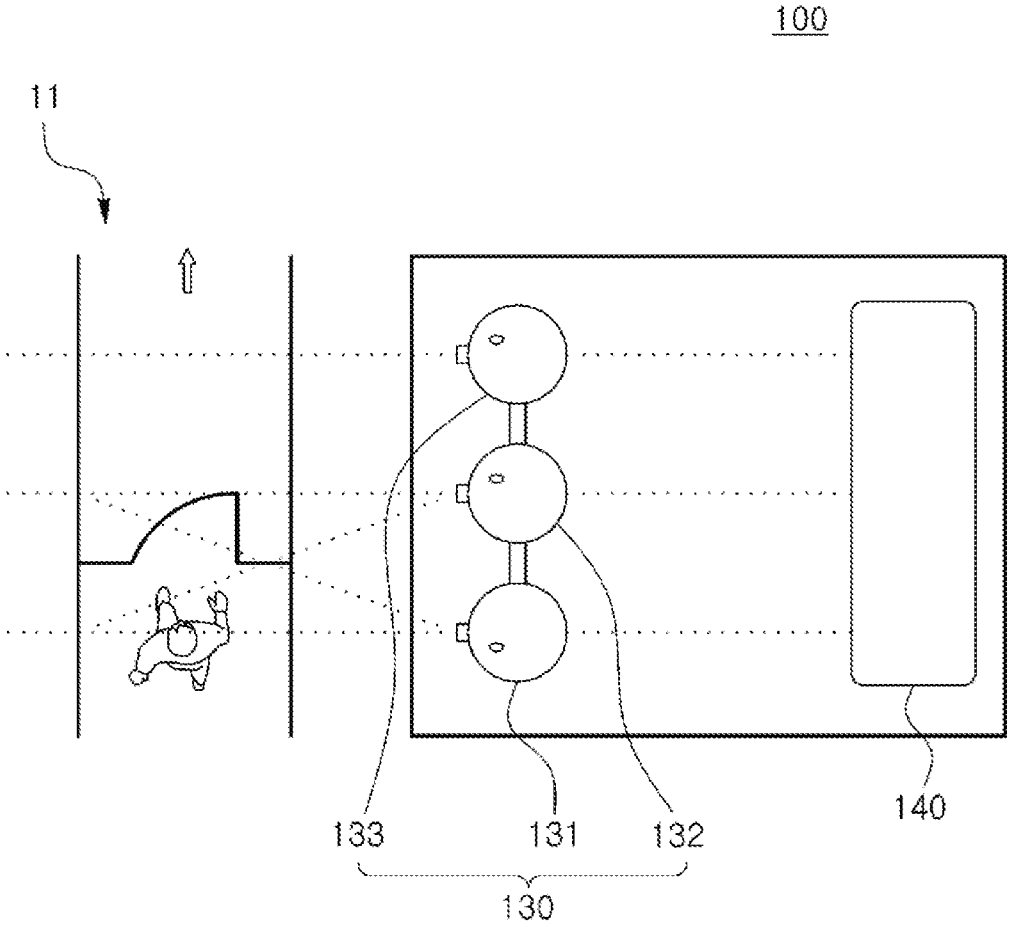
FIG. 6 is a view schematically illustrating an accident preventing system for sports according to another embodiment of the present disclosure.
Figure 7:
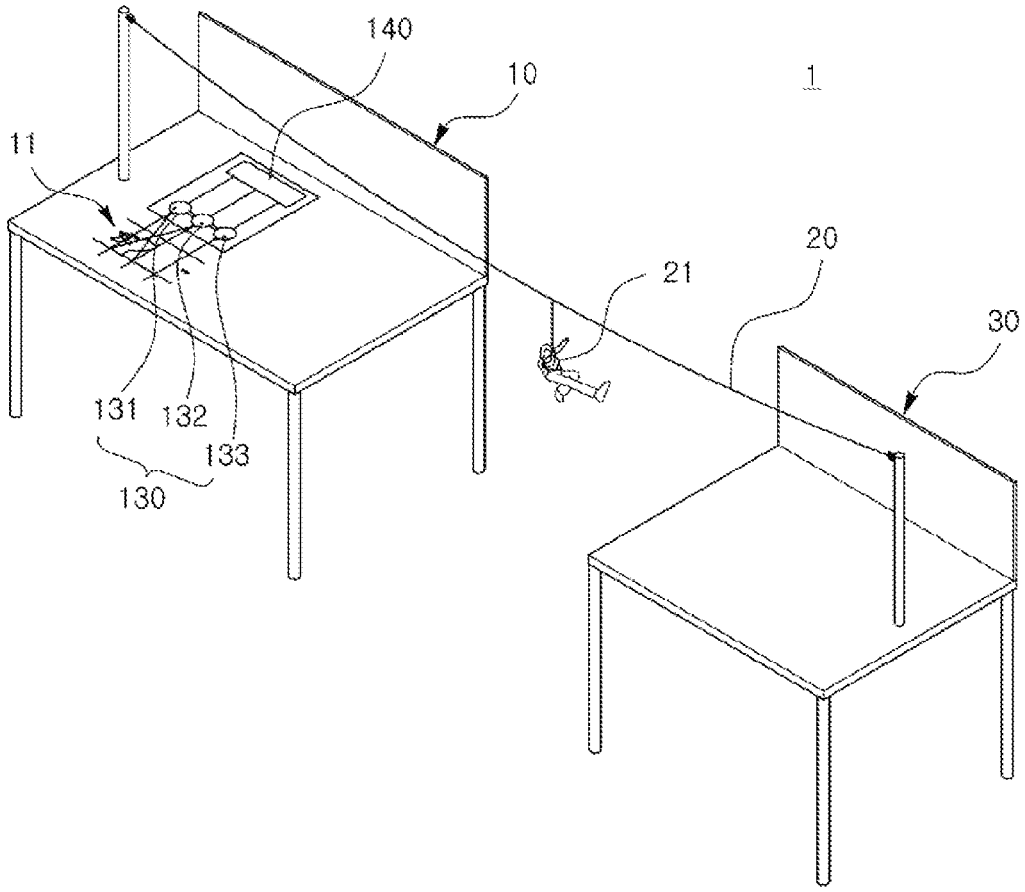
FIG. 7 is a view schematically illustrating sports facilities installed according to an embodiment of the present disclosure.

FIG. 6 is a view schematically illustrating an accident preventing system for sports according to another embodiment of the present disclosure, and FIG. 7 is a view schematically illustrating sports facilities installed according to an embodiment of the present disclosure.

Referring to FIGS. 6 and 7, a sport facility 1 may include a first zone 10, a facility member 20, and a second zone 30.

The sport facility 1 refers to a facility in which a user may move from the first zone 10 to the second zone 30. The sport facility 1 involves traversing over mountain, lake, river, sea, and the like, or movement in the air. The sport facility 1 may include bungee jumping, euro jump, and zipline, and the like.

The first zone 10 may include a starting spot 11 for a user to use the sport facility 1 installed according to the present disclosure. In the first zone 10, the user may prepare for using the sport facility 1 and wear a safety equipment 110. The first zone may be higher than the second zone 30.

The second zone 30 may include an arrival spot for the user to use the sport facility 1 installed according to the present disclosure.

The facility member 20 may be installed to allow the user to move between the first zone 10 and the second zone 30 spaced apart from each other. The facility member 20 may be installed only in the first zone 10 or only in the second zone 30. Also, the facility member 20 may be installed both in the first zone 10 and the second zone 30. For example, in the case of bungee jumping, one end of the facility member 20 may be connected to the first zone 10, and the other end may be connected to the safety equipment 110 worn on the user. In the case of euro jump, two facility members 20 may be used. Each of the facility members 20 may be connected to the first zone 10 and the safety equipment 110 worn on the user. Also, in the case of zipline, two facility members 20 may be used. A first facility member may connect the first zone 10 and the second zone 30. One end of a second facility member may be connected to the first facility member and the other end thereof may be connected to the safety equipment 110 worn on the user.

The facility member 20 may include a facility member coupling part 21. The facility member coupling part 21 may be positioned at one end of the facility member 20 and connected to the safety equipment 110 worn on the user. The facility member coupling part 21 may include a sensor sensed through a coupling sensing unit 133.

The sensing unit 130 may include the coupling sensing unit 133. The coupling sensing unit 133 may be installed in the first zone 10. The coupling sensing unit 133 may check coupling between the safety equipment 110 and the facility member coupling part 21. The coupling sensing unit 133 may check coupling of the facility member coupling part 21 within a sensing-available area. Although not shown, sensors used in the entry sensing unit 131, the binding sensing unit 132, and the coupling sensing unit 133 may be integrated to be implemented as a single module.

Figure 8:
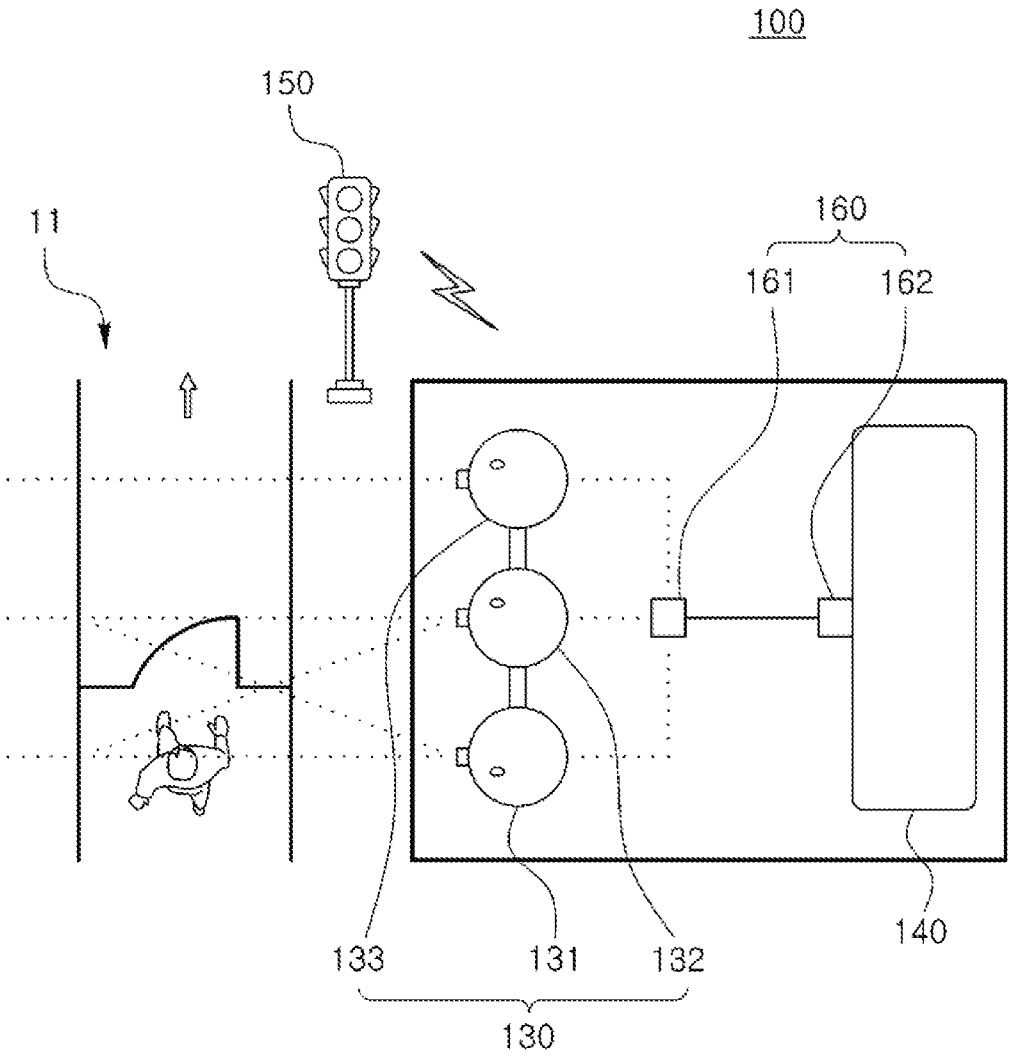
FIG. 8 is a view schematically illustrating an accident preventing system for sports according to another embodiment of the present disclosure.

FIG. 8 is a view schematically illustrating an accident preventing system for sports according to another embodiment of the present disclosure.

Referring to FIG. 8, an accident preventing system 100 for sports may include a warning unit 150 and a transfer unit 160.

The warning unit 150 may give a warning when two or more users enter the starting spot 11 through the entry sensing unit 131. The warning unit 150 may give a warning when the safety equipment 110 is not bound a human body through the binding sensing unit 132. Also, the warning unit 150 may give a warning when the safety equipment 110 and the facility member coupling part 21 are not coupled through the coupling sensing unit 133. The warning unit 150 may determine whether a user uses the sport facility 1 through a signal transmitted from the controller 140 and give a warning. Upon receiving a signal through the controller 140, the warning unit 150 may inform the user about whether the sport facility 1 is abnormal. The warning unit 150 may visually or audibly derive signals received from the entry sensing unit 131, the binding sensing unit 132, and the coupling sensing unit 133. The warning unit 150 may give a warning through a specific sound or music, light, a flag, a display device, and the like.

The transfer unit 160 may include a signal transmitting unit 161 and a signal receiving unit 162.

The signal transmitting unit 161 may transmit sensed signals received from the entry sensing unit 131, the binding sensing unit 132, and the coupling sensing unit 133 to the signal receiving unit 162. The signal transmitting unit 161 may be connected to the entry sensing unit 131, the binding sensing unit 132, and the coupling sensing unit 133 wiredly or wirelessly. The signal transmitting unit 161 may be positioned in the vicinity of the sensing unit 130.

The signal receiving unit 162 may receive a signal transmitted from the signal transmitting unit 161, and may transfer the received signal to the controller 140. The signal receiving unit 162 may be connected to the controller 140 wiredly or wirelessly. The signal receiving unit 162 may be positioned in the vicinity of the signal transmitting unit 161 and may be included in the controller 140.

Figure 9:
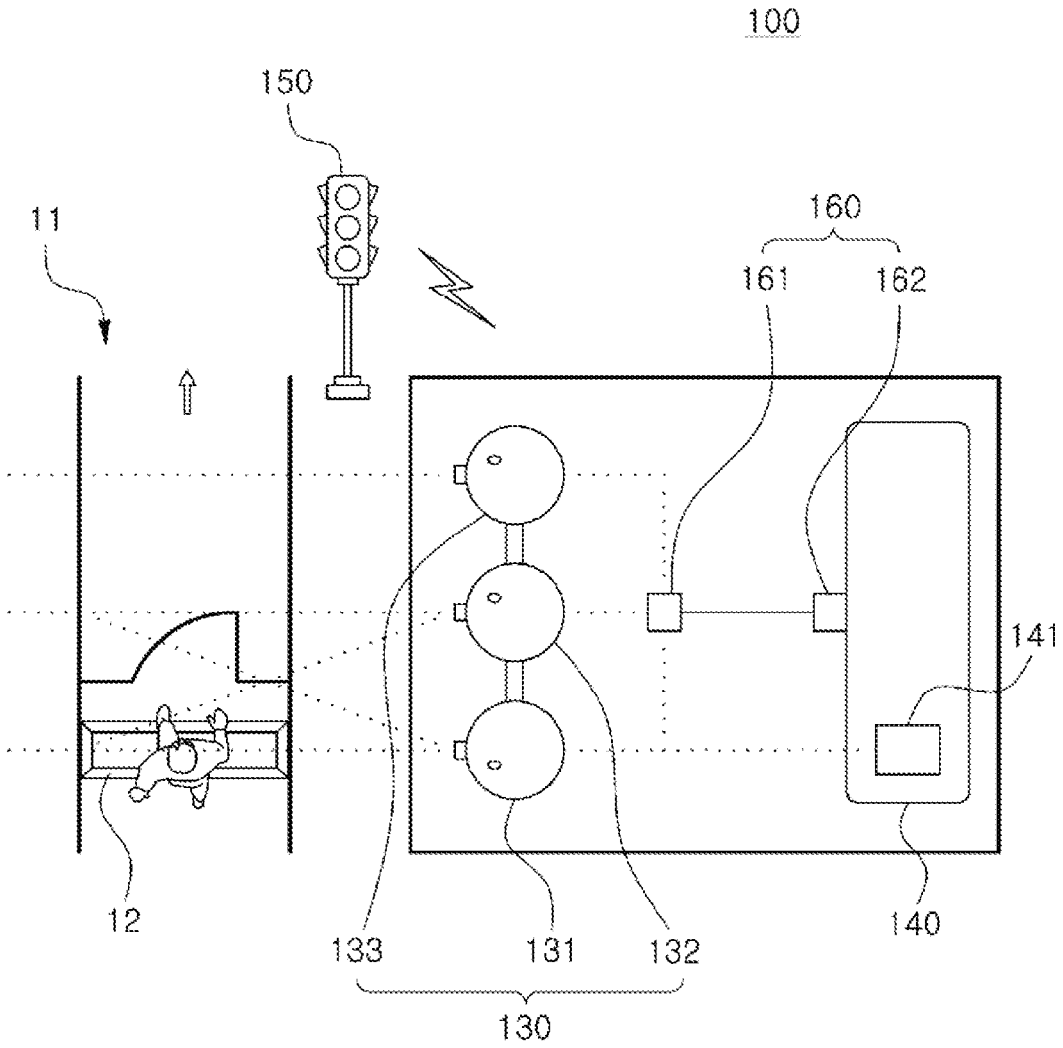
FIG. 9 is a view schematically illustrating an accident preventing system for sports according to another embodiment of the present disclosure.

FIG. 9 is a view schematically illustrating an accident preventing system for sports according to another embodiment of the present disclosure.

Referring to FIG. 9, the entry sensing unit 131 that senses user's entry may use a weight sensor. When a user passes through the starting spot 11 in which a step board 12 is installed, the weight sensor may measure a weight of the user and check entry of the user.

A tension measurement unit 141 may be included in the controller 140. The tension measurement unit 141 may calculate tension acting on the facility member 20 due to the weight of the user measured by the weight sensor.

Figure 10:
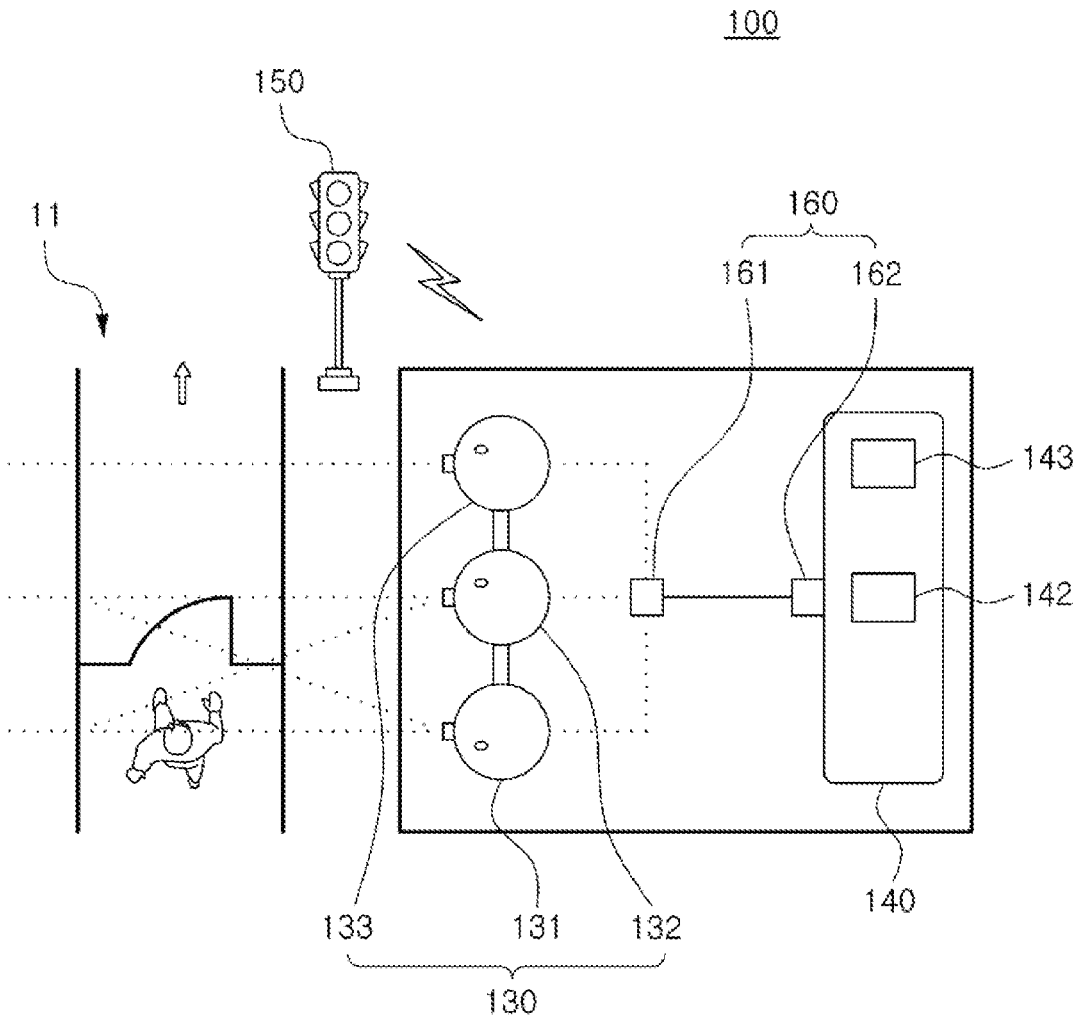
FIG. 10 is a view schematically illustrating an accident preventing system for sports according to another embodiment of the present disclosure.
Figure 11:
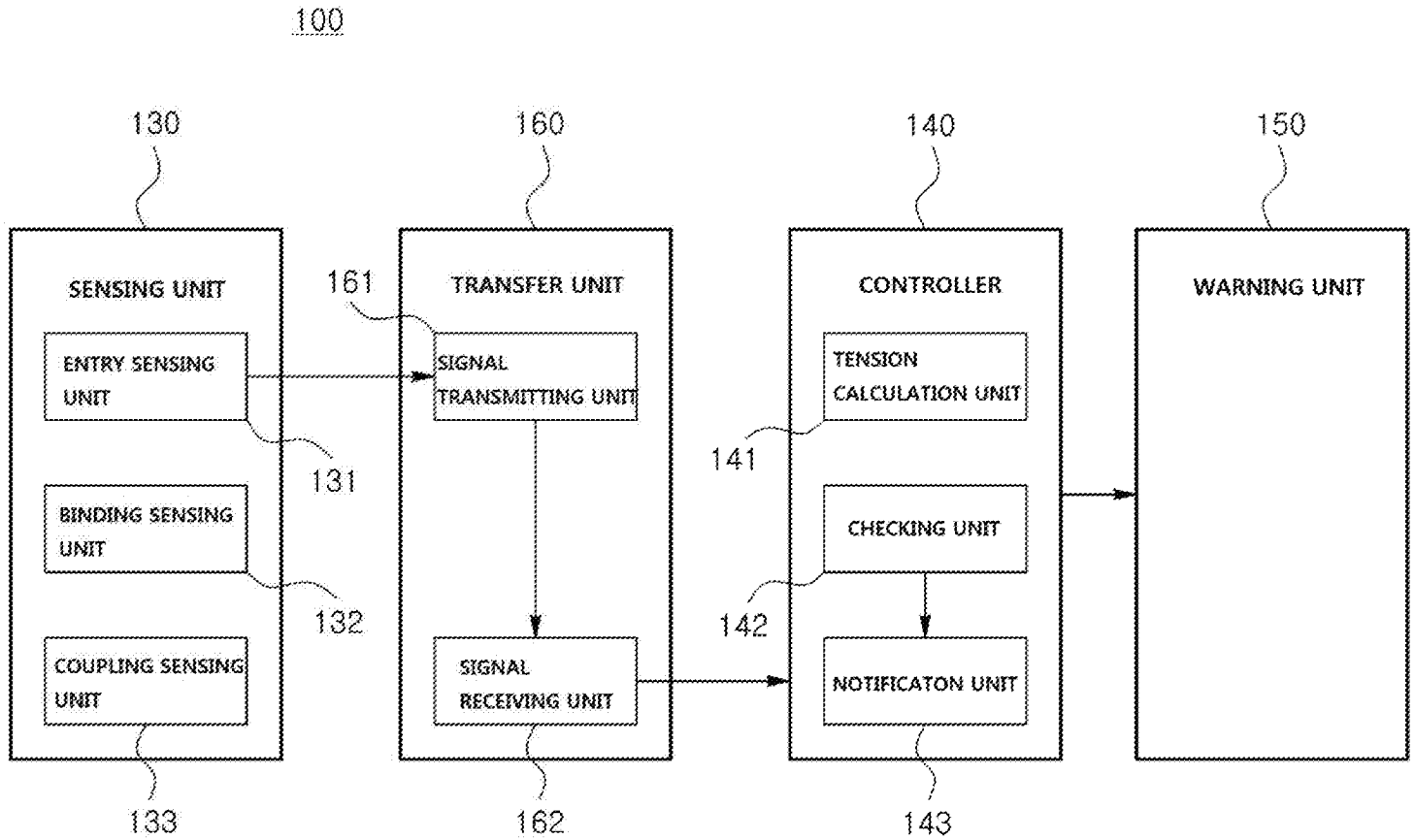
FIG. 11 is a block diagram of an accident preventing system for sports according to an embodiment of the present disclosure.

FIG. 10 is a view schematically illustrating an accident preventing system for sports according to another embodiment of the present disclosure, and FIG. 11 is a block diagram of an accident preventing system for sports according to an embodiment of the present disclosure.

Referring to FIGS. 10 and 11, the controller 140 may include a checking unit 142 and a notification unit 143.

The checking unit 142 may determine whether the entry sensing unit 131, the binding sensing unit 132, and the coupling sensing unit 133 sense a signal. The checking unit 142 may check an operation of the entry sensing unit 131, the binding sensing unit 132, and the coupling sensing unit 133 periodically or frequently.

The notification unit 143 may notify about occurrence of an error when it is determined that the entry sensing unit 131, the binding sensing unit 132, and the coupling sensing unit 133 do not operate. The notification unit 143 may notify that the entry sensing unit 131, the binding sensing unit 132, and the coupling sensing unit 133 do not operate through a specific sound or music, light, a flag, a display device, and the like. The notification unit 143 may be connected to the checking unit 142 wiredly or wirelessly.

Figure 12:
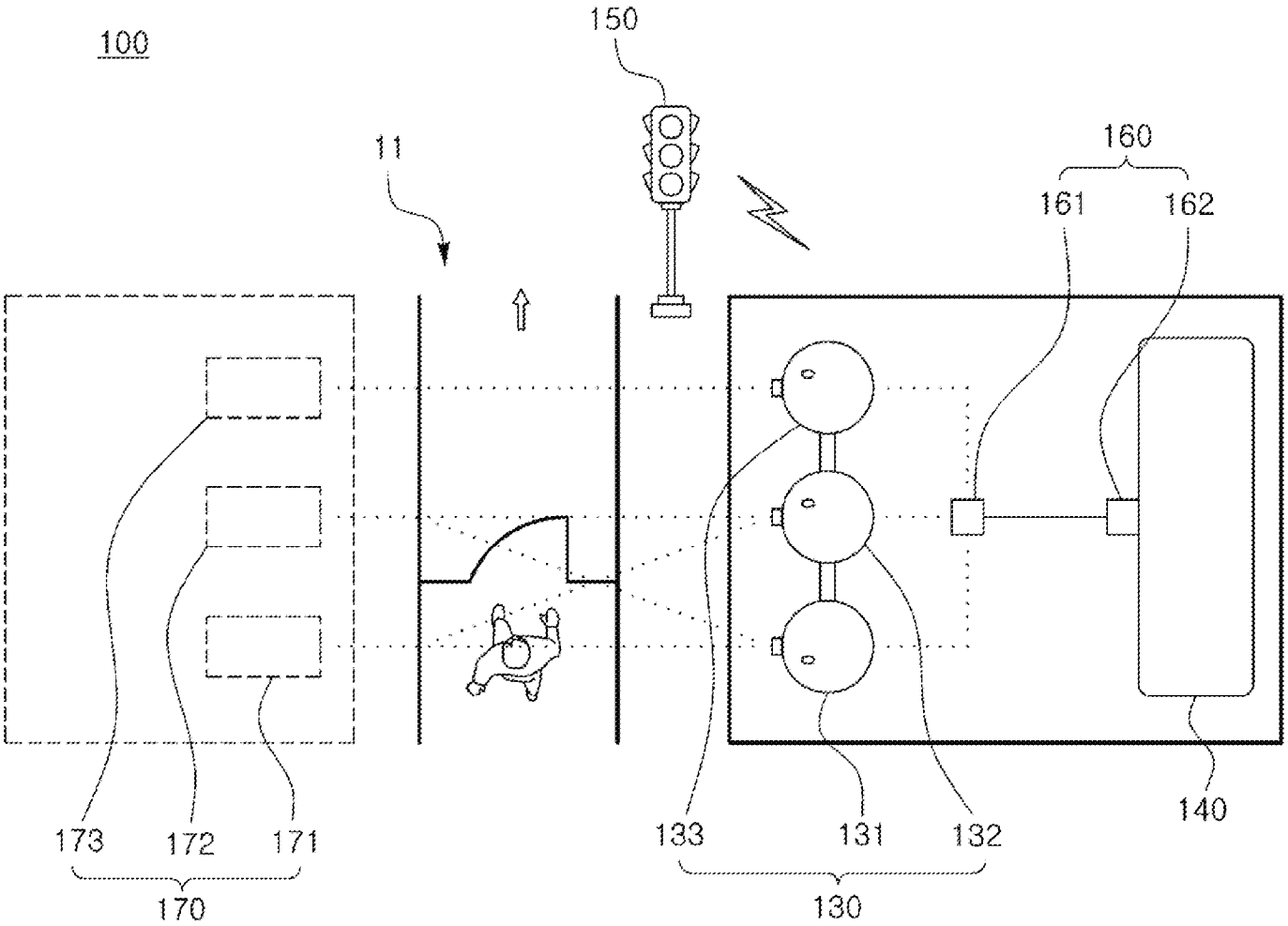
FIG. 12 is a view schematically illustrating an accident preventing system for sports according to another embodiment of the present disclosure.

FIG. 12 is a view schematically illustrating an accident preventing system for sports according to another embodiment of the present disclosure.

Referring to FIG. 12, an accident preventing system 100 for leisure sports may include an emergency sensing unit 170. The emergency sensing unit 170 may include an emergency entry sensing unit 171, an emergency binding sensing unit 172, and an emergency coupling sensing unit 173. When the entry sensing unit 131 does not operate, the emergency entry sensing unit 171 may serve to replace a function of the entry sensing unit 131. When the binding sensing unit 132 does not operate, the emergency binding sensing unit 172 may serve to replace a function of the binding sensing unit 132. When the coupling sensing unit 133 does not operate, the emergency coupling sensing unit 173 may serve to replace a function of the coupling sensing unit 133.

The various embodiments of the present disclosure have been described in detail up to now. Although the embodiments of the present disclosure have been disclosed for illustrative purposes, those skilled in the art will appreciate that various modifications, additions and substitutions are possible, without departing from the scope and spirit of the invention as disclosed in the accompanying claims. It should be understood that the exemplary embodiments described therein should be considered in a descriptive sense only and not for purposes of limitation. And, various changes and modifications that fall within the scope of the claims, or equivalents of such scope are therefore intended to be embraced by the appended claims.

What is claimed is:

1. An accident preventing system for sports, for preventing an accident to a user who uses a sport facility involving movement from a first zone including a starting spot to a second zone including an arrival spot, the accident preventing system comprising:

a safety equipment that a user wears to use the sport facility;

an entry sensing unit installed in the first zone and determining that the user enters the starting spot;

a binding sensing unit installed in the first zone and determining whether the safety equipment is bound;

a controller determining whether to operate the sport facility upon receiving signals checked by the entry sensing unit and the binding sensing unit; and wherein the safety equipment includes a safety equipment coupling part binding the safety equipment worn on the user, a safety equipment coupling sensor determining whether the safety equipment coupling part is bound, wherein the safety equipments further includes a safety equipment upper part covering the user's upper body and a safety equipment lower part covering the user's thighs, and wherein the safety equipment coupling part includes a safety equipment first coupling part binding the safety equipment upper part not to be slipped, and a safety equipment second coupling part binding the safety equipment lower part not to be slipped.

2. The accident preventing system of claim 1, further comprising:

a starting spot gate installed in the starting spot and preventing entry of another user when the user's entry is checked.

3. An accident preventing system for sports, for preventing an accident to a user who uses a sport facility involving movement from a first zone including a starting spot to a second zone including an arrival spot, the accident preventing system comprising:

a safety equipment that a user wears to use the sport facility;

an entry sensing unit installed in the first zone and determining that the user enters the starting spot;

a binding sensing unit installed in the first zone and determining whether the safety equipment is bound;

a controller determining whether to operate the sport facility upon receiving signals checked by the entry sensing unit and the binding sensing unit;

at least one facility member installed in the first zone and the second zone to allow the user to move from the first zone to the second zone;

a facility member coupling part positioned at an end of the facility member and coupled to the safety equipment; and a coupling sensing unit installed in the first zone and checking coupling between the facility member coupling part and the safety equipment.

4. The accident preventing system of claim 3, further comprising:

a signal transmitting unit transmitting signals sensed by the entry sensing unit, the binding sensing unit, and the coupling sensing unit;

a signal receiving unit receiving a signal transmitted from the signal transmitting unit and transferring the received signal to the controller; and a warning unit determining whether the user is allowed to use the sport facility through a signal transferred from the controller, and give a warning.

5. The accident preventing system of claim 3, wherein the entry sensing unit includes a weight sensor measuring a weight of the user and checking the user's entry, and the controller includes a tension calculation unit calculating tension acting on the facility member due to the weight of the user measured through the weight sensor.

6. The accident preventing system of claim 3, wherein the controller includes:

a checking unit determining whether the entry sensing unit, the binding sensing unit, and the coupling sensing unit sense a signal; and a notification unit notifying about occurrence of an error when it is determined through the checking unit that the entry sensing unit, the binding sensing unit, and the coupling sensing unit do not operate.

7. The accident preventing system of claim 6, further comprising:

an emergency sensing unit installed in the first zone and replacing a signal sensing function when it is determined through the checking unit that the entry sensing unit, the binding sensing unit, and the coupling sensing unit do not operate.

* * * * *